US006918368B2

(12) United States Patent
Nantz et al.

(10) Patent No.: US 6,918,368 B2
(45) Date of Patent: Jul. 19, 2005

(54) REMOTE START ASSEMBLY WITH CONFIRMATION

(75) Inventors: John Nantz, Brighton, MI (US); Tom Tang, Novi, MI (US); Riad Ghabra, Dearborn Heights, MI (US); Ronald King, Brownstown, MI (US); Thomas LeMense, Farmington, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/249,902

(22) Filed: May 16, 2003

(65) Prior Publication Data

US 2004/0226529 A1 Nov. 18, 2004

(51) Int. Cl.[7] ..... F02N 11/08
(52) U.S. Cl. ..... 123/179.2
(58) Field of Search ..... 123/179.2; 180/167, 180/169; 307/10.6

(56) References Cited

U.S. PATENT DOCUMENTS 3,577,164 A * 5/1971 Re Baratelli et al. .... 123/179.2
4,674,454 A * 6/1987 Phairr ..... 123/179.2
5,054,569 A * 10/1991 Scott et al. ..... 180/167

* cited by examiner

*Primary Examiner*—Andrew M. Dolinar
(74) *Attorney, Agent, or Firm*—Bill Panagos

(57) ABSTRACT

An automotive remote start assembly 10 for use in an automobile 14 is provided. The automotive remote start assembly 10 includes a portable remote device 12 having a remote transmitter element 18 and a remote receiver element 20 in communication with a remote controller element 16. The remote controller element 16 is configured to transmit an operator initiated ignition signal 24, receive a main system confirmation signal 34, and transmit a remote system confirmation signal 42 upon receipt of the main system confirmation signal 34. The automotive remote start assembly 10 further includes an in-vehicle remote start module 26 having an internal transmitter element 30 and an internal receiver element 32 in communication with an internal controller element 28. The internal controller element 28 is configured to receive the operator initiated ignition signal 24, transmit the main system confirmation signal 34 upon receipt of the operator initiated ignition signal 24, and receive the remote system confirmation signal 42. An engine assembly 15 is in communication with the in-vehicle remote start module 26 such that the in-vehicle remote start module 26 can activate the engine assembly 15 upon receipt of the remote system confirmation signal 42.

4 Claims, 3 Drawing Sheets

REMOTE START ASSEMBLY WITH CONFIRMATION

BACKGROUND OF INVENTION

The present invention relates generally to an automotive remote start ignition assembly and method and more specifically to an automotive remote start ignition assembly and method including confirmation algorithm.

Present automotive design goals are presently driven by a combination of customer convenience and safety. These design motivations have resulted in a vast array of automotive developments that have permanently altered the landscape of customer expectations in the automotive field. Despite the large number of developments that have arisen, it is recognized that often after conception, development, and implementation many of these developments can remain substantially unchanged in their configurations. Often, however, these developments can merit revisitation in order to fully evaluate their operation as well as to open the door for further improvement. Such is the case regarding automotive remote start ignition assemblies.

Automotive remote start ignition assemblies have been in existence for some time. Their basic principles operate by way of a remote transmitter that signals a receiver within the automobile that triggers the start of the automotive engine. They are utilized by consumers such that the automobile engine may be started from a remote location from the vehicle. This allows a consumer to start the engine from the comfortable confines of the home or office. In cold climates this allows the vehicle interior to be warmed to a comfortable temperatures prior to entry. In warm climates it allows the vehicle air conditioning system to lower the internal temperature prior to entry. Thus the remote start provides a valuable convenience to customers.

As with many existing convenience driven automotive systems, however, present remote start mechanisms often leave considerable room for improvement. One significant arena for improvement stems from the nature of the remote transmission signals. Although designed to be operated from the comfort of a remote location, the remote transmitter may not always reach the vehicle start system and therefore may fail to engage the remote start procedures within the vehicle. This may arise from an excessive transmission distance, transmission impeding structures, diminished transmission strength, or a variety of other factors. These factors can be intermittent and varying depending on the location of the operator and the condition of the transmitter. The resulting effect is that the operator can be unaware if upon operation of the transmitter the connection to the vehicle receiver has been made and the desired start operations have been implemented. This can result in a failure of the remote start operations. In order to compensate for this possibility, consumers often only operate the remote start where visual line of sight confirmation can be utilized. This impacts the value and utility of existing remote start systems.

Additional areas of improvement arise out of unintentional implementation of existing remote start assemblies. The convenience of many remote transmitter profiles can lead to their placement in pockets or handbags wherein their transmission features may be implemented through contact with surrounding objects. This may lead to an undesired concern on the part of the owner as to the placement or storage of the remote transmitter. Adult limited operation may also lead owners to place restrictive control over such transmitters. The nature of convenience features, such as remote start transmitters, dictates that such objects should optimally be easily stored and transported in a wide variety of environments without distracting the operator with such concerns.

It would therefore be highly desirable to have an automotive remote start assembly that provided confirmation to the operator of successful activation without the necessity of line-of-sight vehicle confirmation. It would further be highly desirable to have an automotive remote start assembly that increased customer confidence in regards to unintentional operation.

SUMMARY OF INVENTION

It is therefore an object to the present invention to provide an automotive remote start assembly with confirmation capabilities. It is further object to the present invention to provide an automotive remote start assembly with increased customer confidence regarding unintentional operation prevention.

In accordance with the objects of the present invention an automotive remote start assembly for use in an automobile is provided. The automotive remote start assembly includes a portable remote device having a remote transmitter element and a remote receiver element in communication with a remote controller element. The remote controller element is configured to transmit an operator initiated ignition signal, receive a main system confirmation signal, and transmit a remote system confirmation signal upon receipt of the main system confirmation signal. The automotive remote start assembly further includes an in-vehicle remote start module having an internal transmitter element and an internal receiver element in communication with an internal controller element. The internal controller element is configured to receive the operator initiated ignition signal, transmit the main system confirmation signal upon receipt of the operator initiated ignition signal, and receive the remote system confirmation signal. An engine assembly is in communication with the in-vehicle remote start module such that the in-vehicle remote start module can activate the engine assembly upon receipt of the remote system confirmation signal.

Other objects and features of the present invention will become apparent when viewed in light of the detailed description and preferred embodiment when taken in conjunction with the attached drawings and claims.

DETAILED DESCRIPTION

Figure 1:
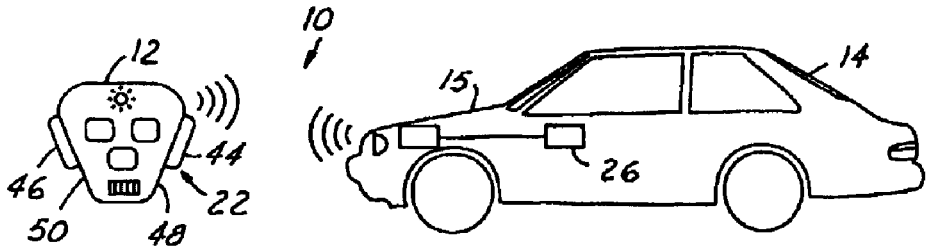
FIG. 1 is an illustration of an automotive remote start assembly in accordance with the present invention.

Referring now to FIG. 1, which is an illustration of an automotive remote start assembly 10 in accordance with the present invention. The automotive remote start assembly 10 includes a portable remote device 12 in communication with an automobile 14 such that the vehicle engine assembly 15 can be started from a remote location from the automobile 14. This provides a wide variety of benefits, the most significant being that the automobile 14 may be warmed up and readied for operation prior to a user entering the vehicle.

Figure 2:
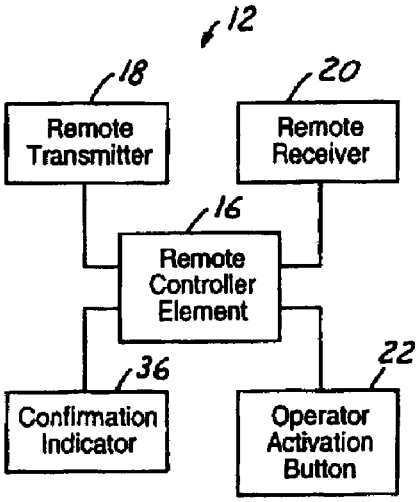
FIG. 2 is a block diagram of a portable remote device for use in the automotive remote start assembly illustrated in FIG. 1.
Figure 4:
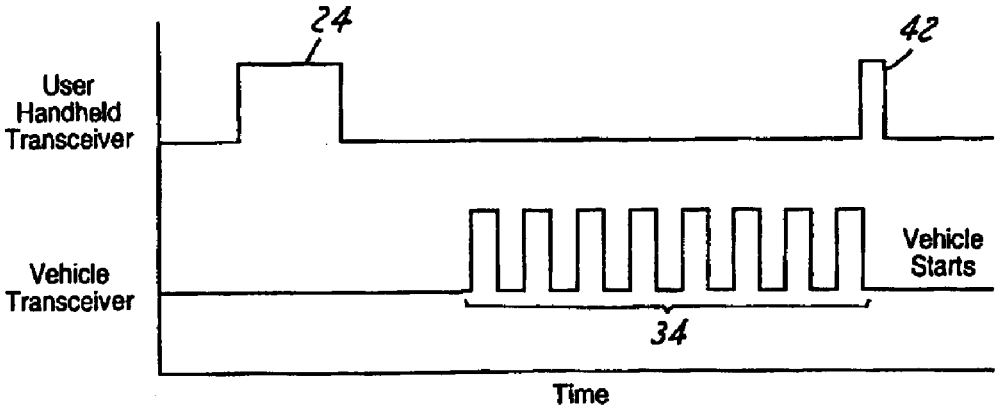
FIG. 4 is an illustration of the transmission signals utilized by the automotive remote start assembly illustrated in FIG. 1.

The portable remote device 12 preferably includes a remote controller element 16 in communication with a remote transmitter element 18 and a remote receiver element 20 (see FIG. 2). The portable remote device 12 may be formed in a variety of fashions, however, at least one embodiment contemplates the use of a portable remote fob as illustrated in FIG. 1. The portable remote device 12 includes at least one operator activation button 22 in communication with the remote controller element 16. Upon the pressing of the operator activation button 22, the portable remote device 12 transmits an operator initiated ignition signal 24 as shown in FIG. 4. The operator initiated ignition signal 24 is contemplated to encompass any of a wide variety of transmissions signals including radio frequency transmissions. It is contemplated that the operator initiated ignition signal 24 may further be configured to include a wide variety of security codes or features in order to prevent unwanted or unintended activation of the vehicle engine assembly 15 through the use of non-owner transmitters.

Figure 3:
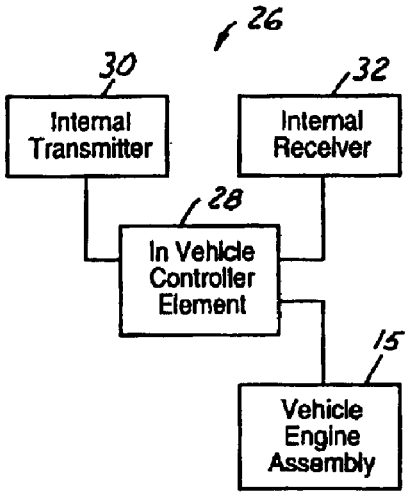
FIG. 3 is a block diagram of an in-vehicle remote start module for use in the automotive remote start assembly illustrated in FIG. 1.

The owner initiated ignition signal 24 communicates with the vehicle engine assembly 15 by way of an in-vehicle remote start module 26 positioned within the automobile 14 and in communication with the vehicle engine assembly 15. The in-vehicle remote start module 26 includes an internal controller element 28 in communication with an internal transmitter element 30 and an internal receiver element 32 (see FIG. 3). The internal receiver element 32 receives the operator initiated ignition signal 24 and communicates it to the internal controller element 28. In response, the in-vehicle remote start module 26 is configured to utilize the internal receiver element 32 to transmit a main system confirmation signal 34 (see FIG. 4). Although a variety of main system confirmation signals 34 are contemplated, one embodiment contemplates the transmission of a plurality of main system confirmation signals 34 that effectively poll for a response from the portable remote device 12.

The remote receiver element 18 and the remote controller element 16 are configured to receive the main system confirmation signal 34. The receipt of the main system confirmation signal 34 allows an establishment of a communication link between the portable remote device 12 and the in-vehicle remote start module 26 prior to activation of the engine assembly 15. This provides the operator with feedback regarding successful communication with the automobile 14. In order to properly communicate this information to the operator, the portable remote device 12 further includes at least one confirmation indicator 36 in communication with the remote controller element 16. Although a variety of confirmation indicators 36 are contemplated, one embodiment contemplates the use of a light-emitting-diode (LED) 38 (see FIG. 1) that is configured to flash upon receipt of the main system confirmation signal 34. The confirmation indicator 36 may also include a speaker 40 (see FIG. 1) that allows for an audio confirmation. These indicators provide a quick and reliable method of communicating the receipt of the main system confirmation signal 34 to the operator.

Upon receipt of the main system confirmation signal 34 and activation of the confirmation indicator(s) 36, the remote controller element 16 is configured such that it can transmit a remote system confirmation signal 42 (see FIG. 4) back to the in-vehicle remote start module 26. It is contemplated that this response may be controlled in a variety of fashions. In one embodiment, an operator activation button 22 may be required to be pressed again in order for the remote confirmation signal 42 to be sent. This allows further reassurance that the operator intends to remote start the automobile 14. In other embodiments, however, the remote system confirmation signal 42 can be automatically sent in response to activation of the confirmation indicators 36 as the operator has thus been made aware of the activation of the engine assembly 15. In either of such configurations, an added level of assurance has been provided to the operator that improves over existing remote start devices. The in-vehicle controller element 28 is configured such that upon receipt of the remote system confirmation signal 42, the in-vehicle controller element 28 activates the engine assembly 15.

Figure 5:
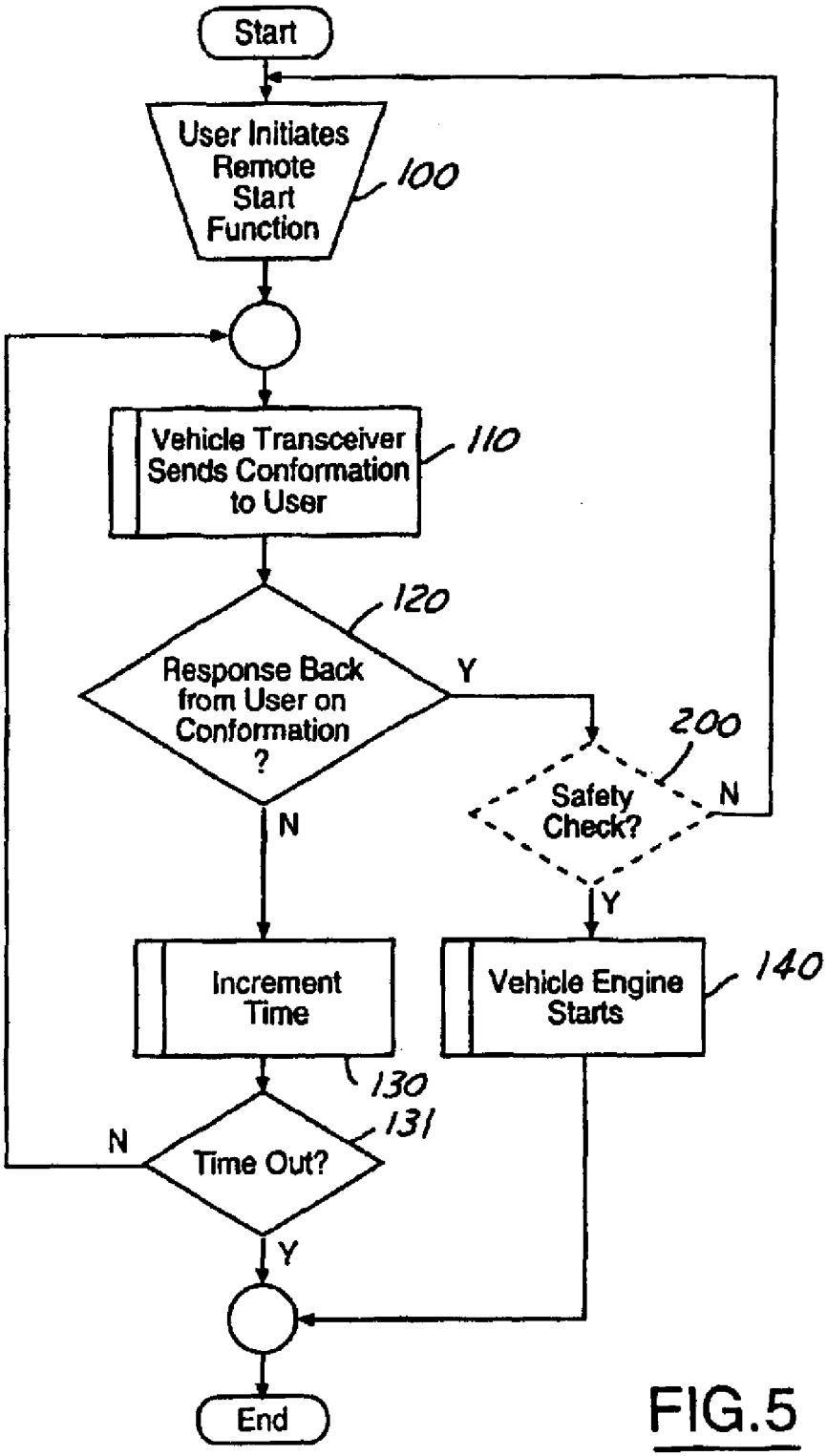
FIG. 5 is an operational flow chart of the automotive remote start assembly illustrated in FIG. 1.

A chart of the operation of the automotive remote start assembly 10 is illustrated in FIG. 5. The operation begins when the user initiates the remote start function 100. This is accomplished by the user activates one of the operator activation buttons 22 and the owner initiated ignition signal 24 is transmitted by the portable remote device 12. The in-vehicle remote start module 26, in response to receipt of the owner initiated ignition signal 24, sends confirmation to the user 110. This is accomplished through the polling of the portable remote device 12 by way of the main confirmation signal 34 transmitted by the in-vehicle controller element 28. A response evaluation 120 is then initiated wherein the in-vehicle controller element 28 awaits receipt of the remote system confirmation signal 42. A timing function 130 can be utilized to limit the allowable response time for receipt of the remote system confirmation signal. If, however, a remote system confirmation signal 42 is received, the vehicle engine is started 140.

Figure 6:
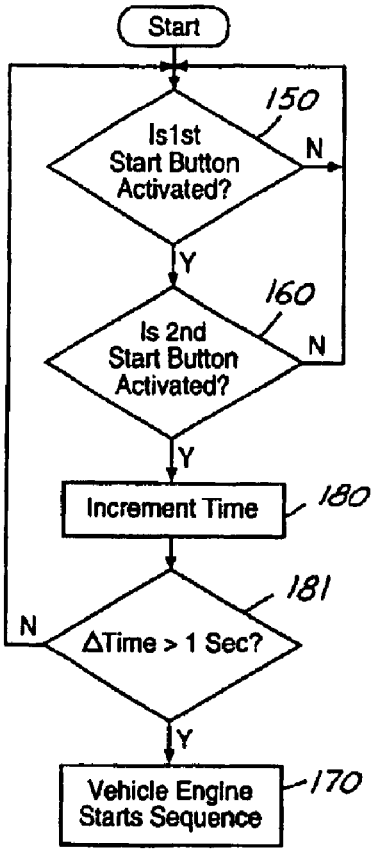
FIG. 6 is an operational flow chart of one embodiment of an operator initiated transmission sequence for use in the remote start assembly.

Although the basic operation of the automotive remote start assembly 10 has thus far been described, it is contemplated that additional reliance features may be implemented to further improve the assembly. In one embodiment, the at least one operator activation button 22 is comprised of a first operator activation button 44 and a second owner activation button 46. The first operator activation button 44 is preferably mounted on a first surface 48 of the portable remote device 12 while the second owner activation button 46 is preferably mounted on a second surface 50, the first and second surfaces preferably being opposing. The positioning of these buttons 44,46 helps prevent unintended activation in addition to preventing activation by children. An operational chart of this feature is illustrated in FIG. 6. The remote controller element 16 is preferably configured such that the first button must be activated 150 and the second button must be activated 160 simultaneously before the operator initiated ignition signal will be sent 170. It is further contemplated that the two buttons must be activated simultaneously over a period of time 180 in order for the operator initiated ignition signal to be sent 170. Although a variety of times for simultaneous activation are contemplated, one embodiment contemplates the simultaneous operation to be greater that one second.

Figure 7:
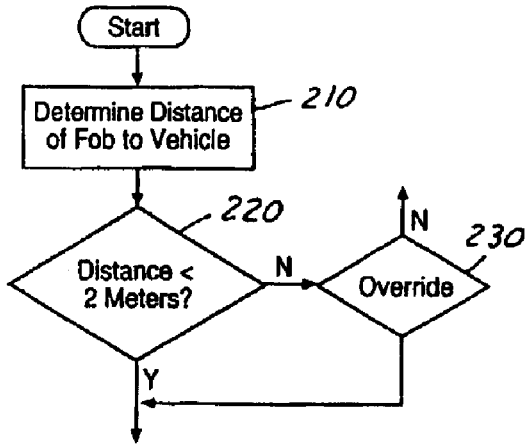
FIG. 7 is an operational flow chart of an optional confidence feature for use in the automotive remote start assembly illustrated in FIG. 5.
Figure 8:
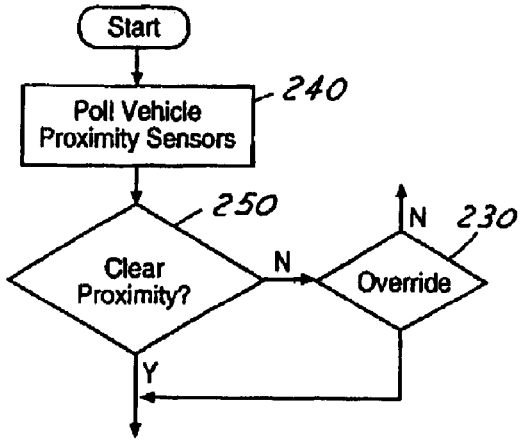
FIG. 8 is an operational flow chart of an operational confidence feature for use in the automotive remote start assembly illustrated in FIG. 5.

An additional feature that may be configured into the automotive remote start assembly 10 takes the form of a safety check 200 configured into the in-vehicle controller element 28. The safety check 200 is preferably configured to prevent the vehicle ignition 140 if desired criteria are not met (see FIG. 5). Although a variety of such criteria are contemplated, FIGS. 7 and 8 illustrate two contemplated configurations. FIG. 7 illustrates a criterion wherein the engine assembly 15 will not be activated if the portable remote device 12 is two close the automobile 14 when the operator initiated ignition signal 24 is transmitted. This is a again highly suitable for the prevention of unintended activation. Although this may be accomplished in a variety of fashions, one embodiment contemplates the determination of distance of the fob to the vehicle 210 and prevention of operation of the distance is less than a pre-set amount 220. The distance of two meters has been used for illustrative purposes. Although a variety of methods for determining the distance are contemplated, one embodiment contemplates the well known methodology for signal distance calculations involving the measuring of transmission time to determine distance. Other methods such as transmission strength are recognized. The automotive remote start assembly 10 may also include an override function 230 such that an operator can bypass this safety feature. Although a variety of override functions 230 are contemplated, one embodiment contemplates the transmission of a second remote system confirmation signal 42.

A second configuration of the safety check 200 is illustrated in FIG. 8. This configuration contemplates the use of proximity sensors 50 in communication with the in-vehicle controller element 28. Proximity sensors 50 are well known in the art of vehicle security. The proximity sensors are polled 240 in order to determine if there is movement surrounding the vehicle 14. If there is movement 250, the activation of the engine assembly 15 is prevented. This prevents activation of the engine assembly 15 if children or pets are within close proximity to the automobile 14. This feature provides users with an added sense of confidence in the system. Similar to the distance determination described in FIG. 7, the proximity check can further include an override function 230 to provide users with even more control.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. An automotive remote start assembly for use in an automobile comprising:

a portable remote device including a remote transmitter element and a remote receiver element in communication with a remote controller element, said remote controller element configured to: transmit an operator initiated ignition signal, receive a main system confirmation signal, and transmit a remote system confirmation signal upon receipt of said main system confirmation signal;

an in-vehicle remote start module including an internal transmitter element and an internal receiver element in communication with an internal controller element, said internal controller element configured to: receive said operator initiated ignition signal, transmit said main system confirmation signal upon receipt of said operator initiated ignition signal, and receive said remote system confirmation signal; and an engine assembly in communication with said in-vehicle remote start module, said in-vehicle remote start module activating said engine assembly upon receipt of said remote system confirmation signal, said remote system confirmation signal automatically sent by said remote controller element upon receipt of said main system confirmation signal.

2. An automotive remote start assembly for use in an automobile comprising:

a portable remote device including a remote transmitter element and a remote receiver element in communication with a remote controller element, said remote controller element configured to: transmit an operator initiated ignition signal, receive a main system confirmation signal, and transmit a remote system confirmation signal upon receipt of said main system confirmation signal;

an in-vehicle remote start module including an internal transmitter element and an internal receiver element in communication with an internal controller element, said internal controller element configured to: receive said operator initiated ignition signal, transmit said main system confirmation signal upon receipt of said operator initiated ignition signal, and receive said remote system confirmation signal;

an engine assembly in communication with said in-vehicle remote start module, said in-vehicle remote start module activating said engine assembly upon receipt of said remote system confirmation signal;

a safety check configured into said internal controller element, said safety check having a engaged and a disengaged state, said safety check in said engaged state preventing said in-vehicle remote start module from activating said engine assembly upon receipt of said remote system confirmation signal; and at least one proximity sensor in communication with said internal controller element, said safety check moved to said engaged state when said at least one proximity sensor is activated.

3. An automotive remote start assembly for use in an automobile comprising:

a portable remote device including a remote transmitter element and a remote receiver element in communication with a remote controller element, said remote controller element configured to: transmit an operator initiated ignition signal, receive a main system confirmation signal, and transmit a remote system confirmation signal upon receipt of said main system confirmation signal;

an in-vehicle remote start module including an internal transmitter element and an internal receiver element in communication with an internal controller element, said internal controller element configured to: receive said operator initiated ignition signal, transmit said main system confirmation signal upon receipt of said operator initiated ignition signal, and receive said remote system confirmation signal;

an engine assembly in communication with said in-vehicle remote start module, said in-vehicle remote start module activating said engine assembly upon receipt of said remote system confirmation signal; and a safety check configured into said internal controller element, said safety check having a engaged and a disengaged state, said safety check in said engaged state preventing said in-vehicle remote start module from activating said engine assembly upon receipt of said remote system confirmation signal, wherein said safety check moves to said engaged state when said portable remote device is positioned less than two meters from said in-vehicle remote start assembly when said operator initiated ignition signal is received by said internal controller element.

4. An automotive remote start assembly as described in claim 3, wherein said portable remote device position is determined by said operator initiated signal transmission time.

* * * * *